US012140405B2

(12) United States Patent
Kilic

(10) Patent No.: US 12,140,405 B2
(45) Date of Patent: Nov. 12, 2024

(54) DEVICE FOR ATTACHING A SIGHT TO A HANDGUN

(71) Applicant: Michael Ali Kilic, Schwebheim (DE)

(72) Inventor: Michael Ali Kilic, Schwebheim (DE)

( * ) Notice: Subject to any disclaimer, the term of this patent is extended or adjusted under 35 U.S.C. 154(b) by 0 days.

(21) Appl. No.: 17/532,293

(22) Filed: Nov. 22, 2021

(65) Prior Publication Data

US 2022/0163292 A1 May 26, 2022

(51) Int. Cl.
*F41G 11/00* (2006.01)
*F41G 1/387* (2006.01)

(52) U.S. Cl.
CPC ..... *F41G 11/003* (2013.01); *F41G 1/387* (2013.01)

(58) Field of Classification Search
CPC ..... F41G 11/003; F41G 1/387
See application file for complete search history.

(56) References Cited

U.S. PATENT DOCUMENTS 4,195,432 A * 4/1980 Hickman ..... F41A 21/08 42/106
4,418,487 A * 12/1983 Strahan ..... F41G 11/001 42/125
8,371,056 B1 * 2/2013 Baker ..... F41G 11/003 42/106
8,393,108 B1 * 3/2013 Wilson ..... F41G 11/003 42/111
8,714,072 B1 * 5/2014 Villarreal ..... F41G 3/165 42/130
8,857,096 B2 * 10/2014 McClintock ..... F41G 11/003 42/72
9,273,930 B2 * 3/2016 Jiminez ..... F41G 11/003
9,470,480 B2 * 10/2016 Kirchhoff ..... F41G 11/001
9,599,438 B1 * 3/2017 Fravor ..... F41G 11/003
9,772,161 B1 * 9/2017 Cheng ..... F41G 11/004
9,797,687 B2 * 10/2017 Zimmer ..... F41G 11/001
D806,818 S * 1/2018 Major ..... D22/108
9,869,531 B1 * 1/2018 Zimmer ..... F41G 11/001
10,254,085 B2 * 4/2019 Willmann ..... F41G 11/004
10,480,887 B2 * 11/2019 Fischer ..... F41A 21/325
10,935,348 B2 * 3/2021 Liu ..... F41C 27/00
11,307,000 B2 * 4/2022 Ma ..... F41G 11/004
(Continued)

*Primary Examiner* — Michelle Clement
(74) *Attorney, Agent, or Firm* — Ian Burns; ATIP Law

(57) ABSTRACT

The invention relates to a device (01) for attaching a sight (03) to a mounting rail (07) of a handgun (02), the mounting rail (07) being disposed on the end of the grip (04) of the handgun (02) facing the barrel, and the device (01) comprising an annular body (09) which can be slid onto the mounting rail (07) in a form-fitting manner and which surrounds the slide (06), the barrel (05) and the mounting rail (07) on the grip (04) of the handgun (02), and a gap for movement being provided between the slide (06) and the inner circumference of the body (09) of the device (01), and the device (01) comprising a clamping device by means of which the body (09) can be clamped on the mounting rail (07) of the grip (04). The clamping device comprises a clamping jaw (10) movably mounted on an actuation means, the clamping jaw (10) being switchable between an open position, in which the clamping jaw (10) does not engage the mounting rail (07), and a clamping position, in which the clamping jaw (10) engages the mounting rail (07) in a fixing manner, by means of the actuation means.

26 Claims, 10 Drawing Sheets

(56) References Cited

U.S. PATENT DOCUMENTS

| | | | | |
|---|---|---|---|---|
| 11,441,869 | B2 * | 9/2022 | Zimmer | F41C 23/04 |
| 2004/0211105 | A1 * | 10/2004 | Arachequesne | F41G 1/02 42/113 |
| 2008/0040965 | A1 * | 2/2008 | Solinsky | F41G 1/345 42/90 |
| 2014/0157644 | A1 * | 6/2014 | Jiminez | F41G 11/003 42/114 |
| 2018/0364009 | A1 * | 12/2018 | Hancosky | F41G 11/003 |
| 2020/0248986 | A1 * | 8/2020 | Hancosky | F41G 11/003 |
| 2022/0112978 | A1 * | 4/2022 | Johnson, Sr. | F41G 11/003 |

* cited by examiner

DEVICE FOR ATTACHING A SIGHT TO A HANDGUN

CROSS REFERENCE TO RELATED APPLICATIONS

This application claims priority under 35 USC § to German Patent Application 102020130869.8 filed 23 Nov. 2020, the entire contents of which are incorporated herein by reference.

FIELD OF THE INVENTION

The invention relates to a device for attaching a sight to a mounting rail of a handgun.

BACKGROUND

Handguns, such as sport pistols or hunting weapons, are used in various leisure activities. Handguns are also of great significance for police and armed forces in averting danger. Front and rear sights are typically provided on known handguns for sighting a target. When sighting the target, the front and rear sights have to be aligned in order to be able to hit the sighted target. This way of taking aim at a target requires a large amount of training since the alignment of the front and rear sights presents a high degree of inaccuracy because of the short barrel of handguns.

To improve aiming when sighting targets with a handgun, it is known for a sight that replaces aiming using front and rear sights to be attached to the handgun. These sights to be additionally attached to the handgun may be a red dot sight, a prism scope or a reflector sight, for example, which are also commonly used on long guns.

Generic devices which are widely referred to as mounts are used to attach the sight to the handgun. These devices can be fixed to a mounting rail on the end of the grip of the handgun facing the barrel and simultaneously allow a sight available as an attachment to be attached. As a result, the device allows selective attachment of the sight to the handgun. The known devices for attaching a sight to a handgun have the disadvantage that the device has to be installed on the grip using suitable tools. The necessity of using installation tools thus precludes quick installation and removal of the device and, consequently, quick attachment and removal of the sight to and from the handgun.

Furthermore, generic devices are known which are fixed to the slide of the handgun. This has the significant disadvantage, however, that the devices are subject to enormous acceleration together with the slide and acceleration forces of several hundred G act on the devices when the handgun is fired. These immense acceleration forces make the devices unusable after a short time. Additionally, the movement of the devices together with the slide during firing of the handgun makes aiming through the sight more difficult for the next shot.

Therefore, an object of the present invention is to propose a new device for attaching a sight to a handgun that can be installed and, if required, removed quickly by hand without any installation tools.

This object may be attained by a device according to the teaching of claim 1.

Advantageous embodiments of the invention are indicated in the dependent claims.

SUMMARY OF ONE EMBODIMENT OF THE INVENTION

Brief Description of One Embodiment of the Present Invention

In one aspect of the invention, there is provided a device for attaching a sight to a mounting rail of a handgun, the mounting rail being disposed on the end of the grip of the handgun facing the barrel. The device may comprise an annular body which can be slid onto the mounting rail in a form-fitting manner and which surrounds the slide, the barrel and the mounting rail on the grip of the handgun, and a gap for movement being provided between the slide and the inner circumference of the body of the device. The device may also comprise a clamping device by means of which the body can be clamped on the mounting rail of the grip, characterized in that the clamping device comprises a clamping jaw movably mounted on an actuator, the clamping jaw being switchable between an open position, in which the clamping jaw does not engage the mounting rail, and a clamping position, in which the clamping jaw engages the mounting rail in a fixing manner, by means of the actuator.

In one aspect of the invention, there is provided a device for attaching a sight to a mounting rail of a handgun, the mounting rail being disposed on the end of the grip of the handgun facing the barrel. The device may comprising annular body means which can be slid onto the mounting rail in a form-fitting manner and which surrounds the slide, the barrel and the mounting rail on the grip of the handgun, and a gap for movement being provided between the slide and the inner circumference of the body means. The device may also comprise clamping means for clamping the body means on the mounting rail of the grip, characterized in that the clamping means comprises a clamping jaw means and actuator means on which the clamping jaw means are movable mounted. The actuator means for switching the clamping jaw means between an open position, in which the clamping jaw means does not engage the mounting rail, and a clamping position, in which the clamping jaw means engages the mounting rail in a fixing manner.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
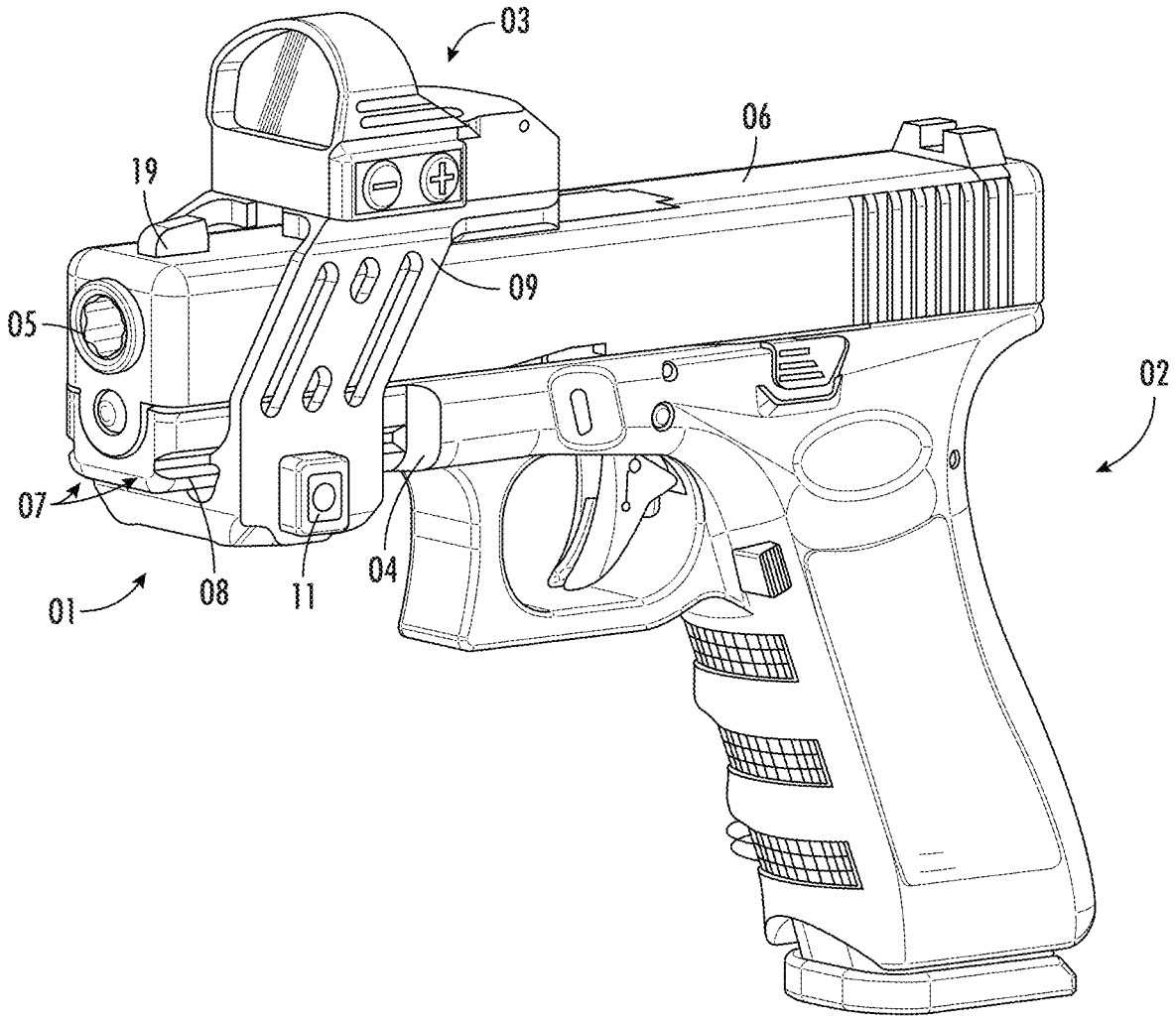
FIG. 1 is a perspective side view of a device according to the invention for installation on a handgun.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The device according to the invention is based on the idea that the clamping device has a clamping jaw for fixing the device to the grip of the handgun, the clamping jaw being movably mounted on an actuation means. The clamping jaw can be switched between an open position and a clamping position by means of the actuation means. In the open position, the clamping jaw is not in contact with the outside of the grip, which means that the device can be easily slid onto or pulled off the mounting rail on the grip of the handgun. When the clamping jaw is in its clamping position on the other hand, the clamping jaw is in contact with the mounting rail of the grip and fixes the device in the respective position by friction. No tools are needed to switch the clamping device between the open position and the clamping position, allowing quick installation and removal of the device on and from the handgun.

The fixation of the device by means of the clamping jaw in its clamping position is based on the friction lock between the clamping jaw and the grip, the holding forces exerted depending on a plurality of basic conditions. The surface properties of the grip in particular may lead to undesired deviation of the holding force from the minimum holding force required. According to a preferred embodiment, a latching element is provided on the clamping device to ensure reliable fixation of the device on the handgun at all times. This latching element can latch into a latching contour on the grip of the handgun in a form fitting manner when the clamping jaw is in the clamping position, precluding the device from being pulled off thereafter. The clamping device cannot be released and the device cannot be removed from the handgun until the latching element is intentionally unlatched.

With a view to a particularly comfortable and quick installation of the device on the handgun, an insertion chamfer is provided on the clamping jaw and/or on the latching element according to a preferred variant. This insertion chamfer comes into contact with the end of one of the two prismatic longitudinal edges of the mounting rail, thereby pushing the clamping device into its open position without assistance by the user, when the body of the device is slid onto the mounting rail. The device can easily be slid onto the mounting rail in this open position. According to another preferred embodiment, the actuation means comprises a tension spring by means of which the clamping jaw is pretensioned in the clamping position to ensure that the device sits securely on the grip.

The actuation means of the device allowing installation on the handgun can basically be of any design. According to a preferred variant, the actuation means comprises a manual actuation element, such as a push button, by means of which the tension spring can be compressed and the clamping jaw can be switched from the clamping position into the open position against the spring force.

A push bar and a push button can be attached in order to transmit the actuation force at the manual actuation element, which may be a push button, to the clamping jaw in a simple manner. This push bar extends through the device below the grip, for example, pressure on the push button causing the clamping jaw to be lifted and released.

With a view to simple and cost-efficient manufacture, it is advantageous if the latching element for form-fitting fixation of the device in the grip is integrated in the push bar in one piece. Furthermore, it is particularly advantageous if the clamping jaw is fixed to the end of the push bar by a fixing screw.

Once the device has been attached to the handgun, the slide still needs to be movable so that the spent round can be ejected and a new round can be chambered. During this movement of the slide, the front sight at the end of the slide is shifted backward by several centimeters. To avoid collision of the front sight with the components of the device, the upper part of the body of the device located opposite the top of the slide can have a corresponding recess. This recess in the body is to be disposed in such a manner that the front sight on the slide can be accommodated in the recess when the slide is pulled back, collision between the body and the front sight being avoided in this way.

To be able to position the sight as close to the user's eye as possible, it is particularly advantageous if the two side parts of the body present an offset. In this way, the bottom of the body can be fixed relatively close to the front of the grip while the sight attached to the top of the body can be positioned at a backward offset. In order to be able to attach other attachments to the handgun in addition to the sight, it is particularly advantageous if an adapter device is provided on the lower part of the body opposite the bottom of the grip. Attachments, in particular lights, can be attached to said adapter device in this case.

The device can basically be made of any material. In order to allow for a particularly light weight, it is advantageous if the body of the device is made in one piece from aluminum or plastic.

FIG. 1 shows a device 01 attached to a handgun 02 and supporting a sight 03, namely a red dot sight. Handgun 02 comprises a grip 04, a barrel 05 and a slide 06.

Figure 2:
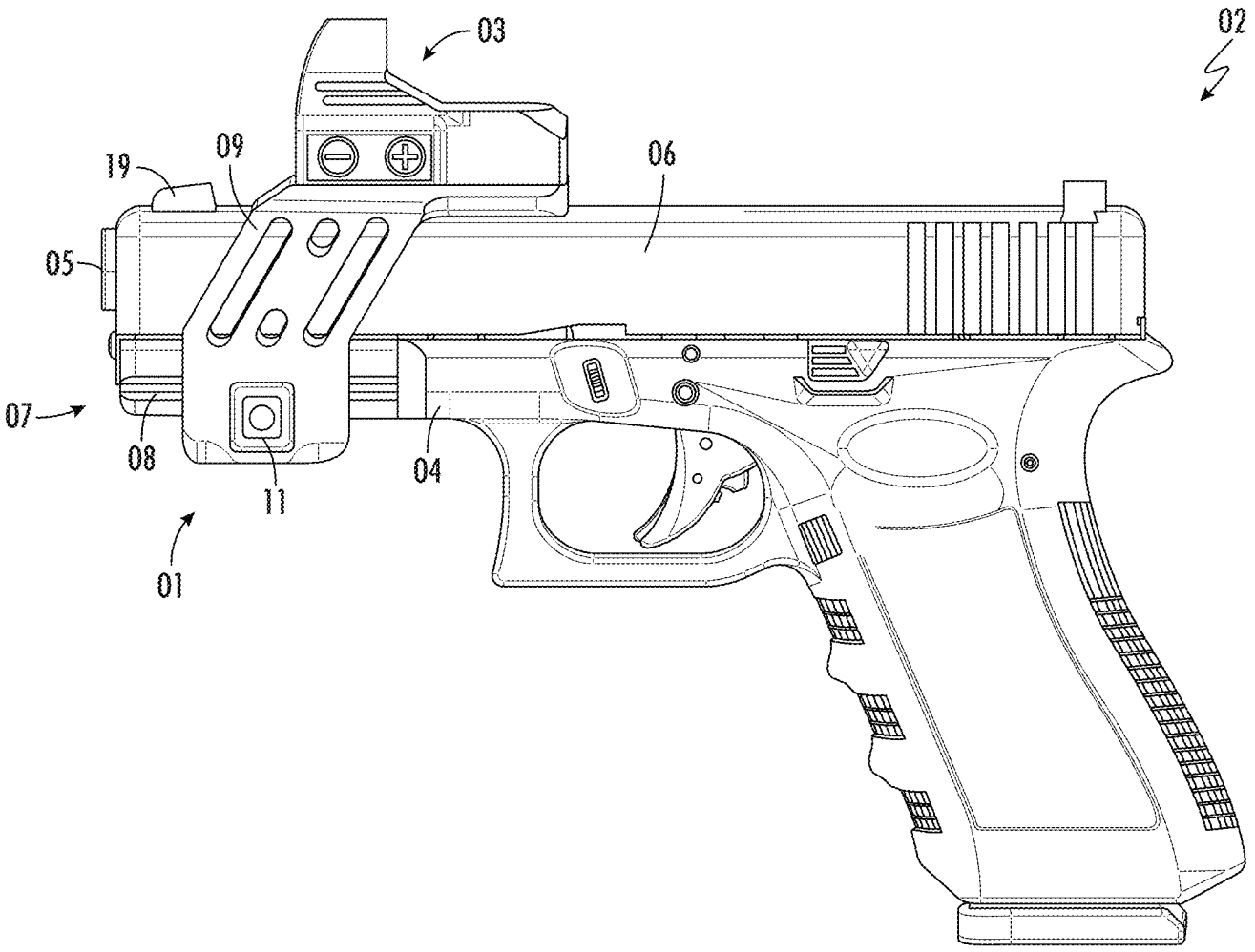
FIG. 2 is a first side view of the device of FIG. 1.

FIG. 2 is a lateral view of handgun 02 with device 01. A mounting rail 07 for attaching device 01 to grip 04 of handgun 02 is provided on the end of grip 04 facing barrel 05, mounting rail 07 comprising two prismatic longitudinal edges 08 on either side of grip 04. Annual body 09 of device 01 is slid onto said two prismatic longitudinal edges 08 from the front. The form fit between body 09 and mounting rail 07 leaves device 01 with a single degree of freedom of movement, namely in the longitudinal direction of barrel 05.

Figure 3:
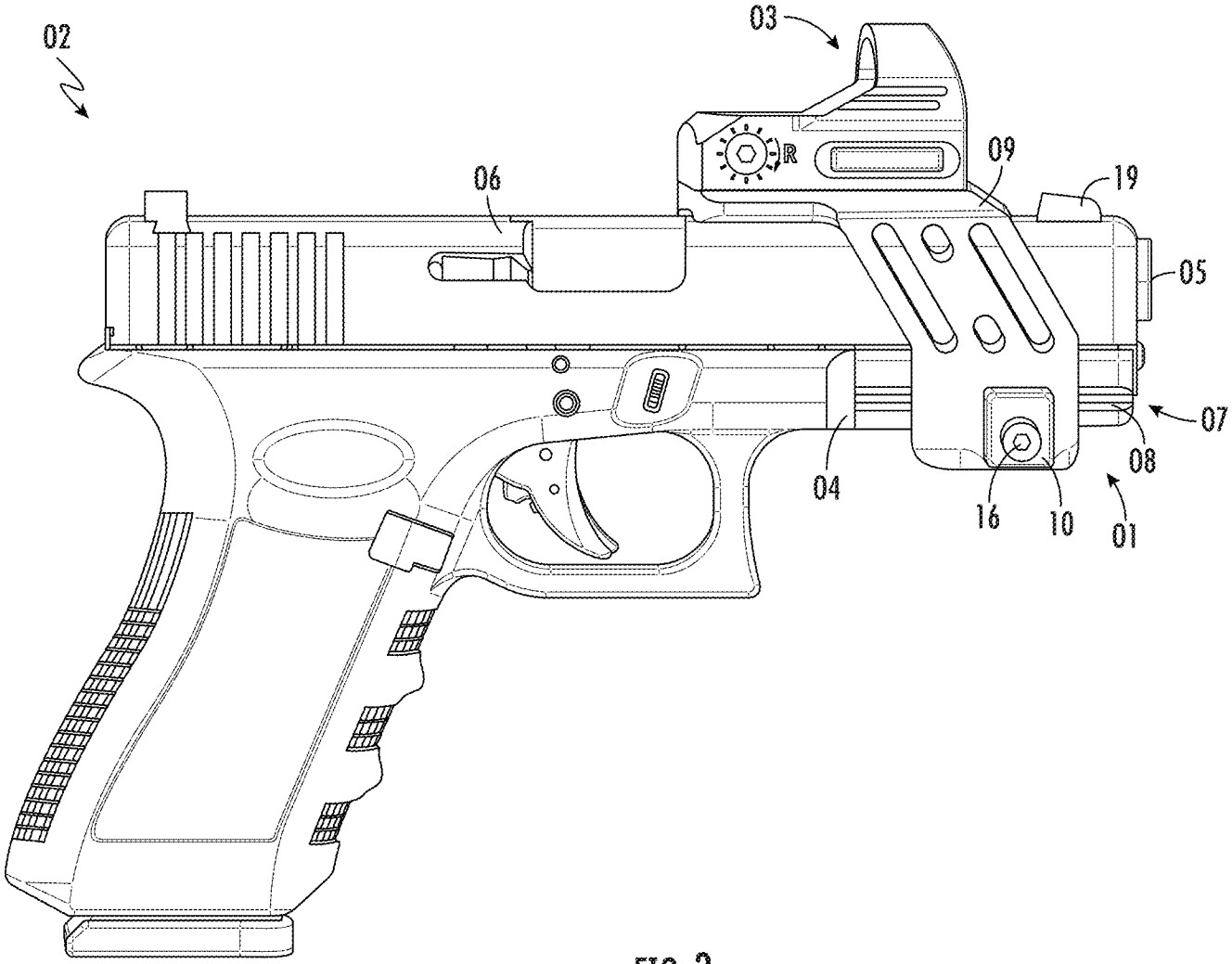
FIG. 3 is a second side view of the device of FIG. 1.

FIG. 3 shows handgun 02 with device 01 from the opposite side. A clamping jaw 10 guided in a recess of body 09 is visible on this side of device 01. The inner side of clamping jaw 10 can be switched between a clamping position and an open position by means of an actuation means, clamping jaw 10 engaging one of the two prismatic longitudinal edges 08 in a friction-locking manner when in the clamping position.

Figure 4:
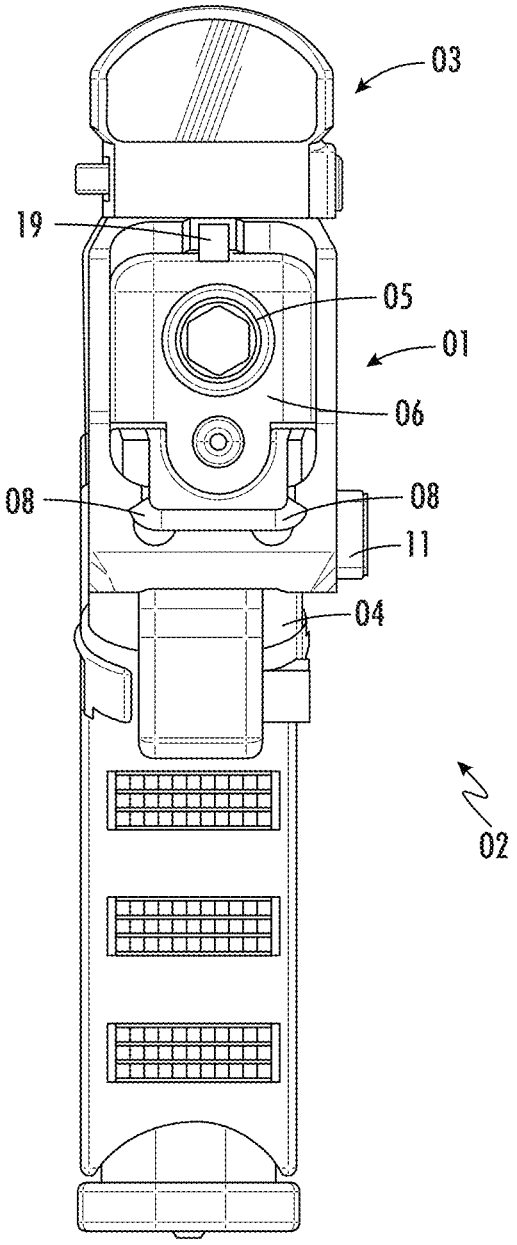
FIG. 4 is a front view of the device of FIG. 1.

FIG. 4 shows handgun 02 with device 01 from the front. A push button 11 which is part of an actuation means for actuating clamping jaw 10 is visible. When the user pushes push button 11, clamping jaw 10 is switched from its clamping position into the open position, allowing device 01 to be pulled off or slid onto mounting rail 07.

Figure 5:
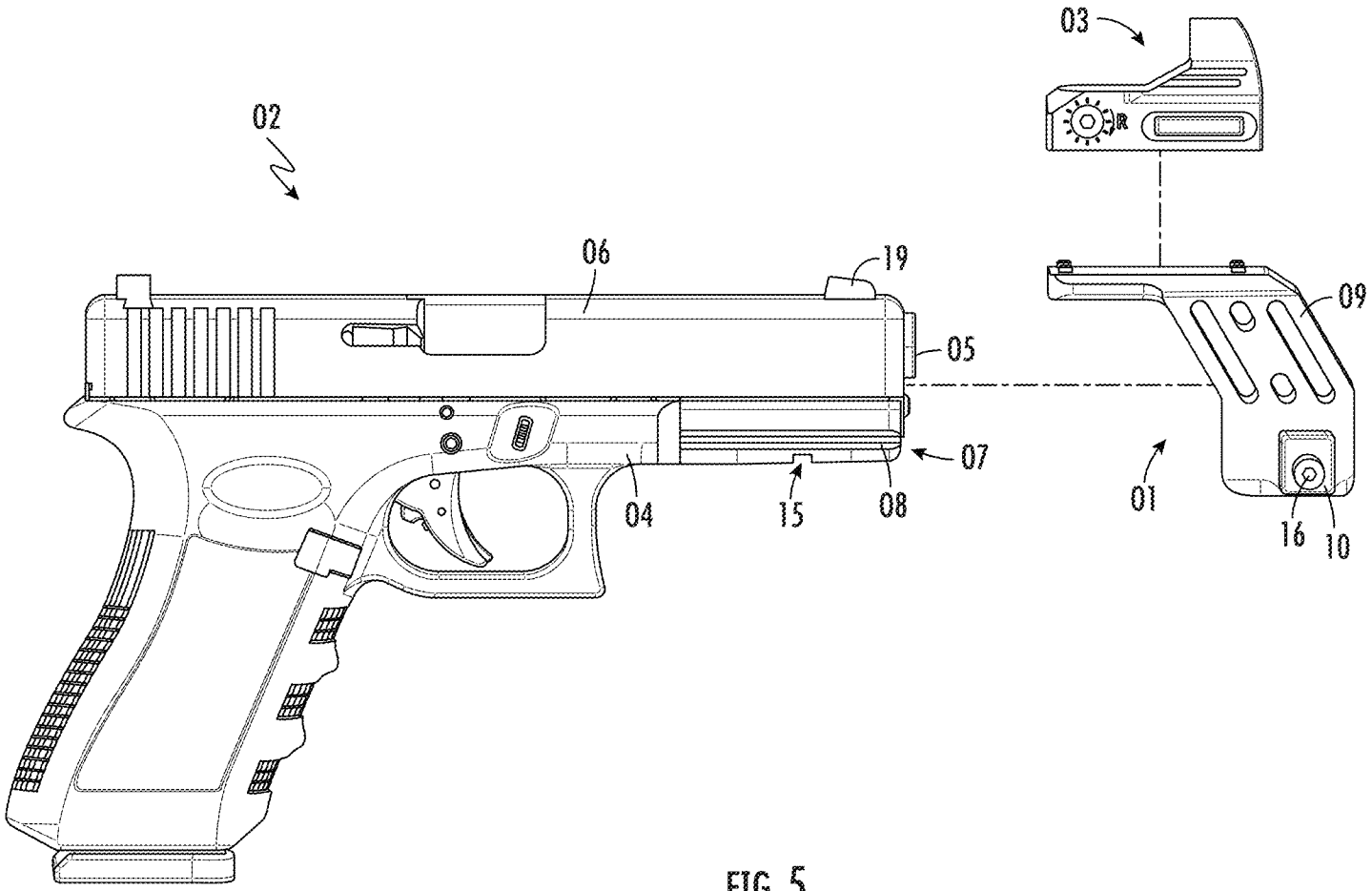
FIG. 5 shows the device of FIG. 1 after removal from the handgun.

FIG. 5 shows device 01 after removal from handgun 02 and removal of sight 03.

Figure 6:
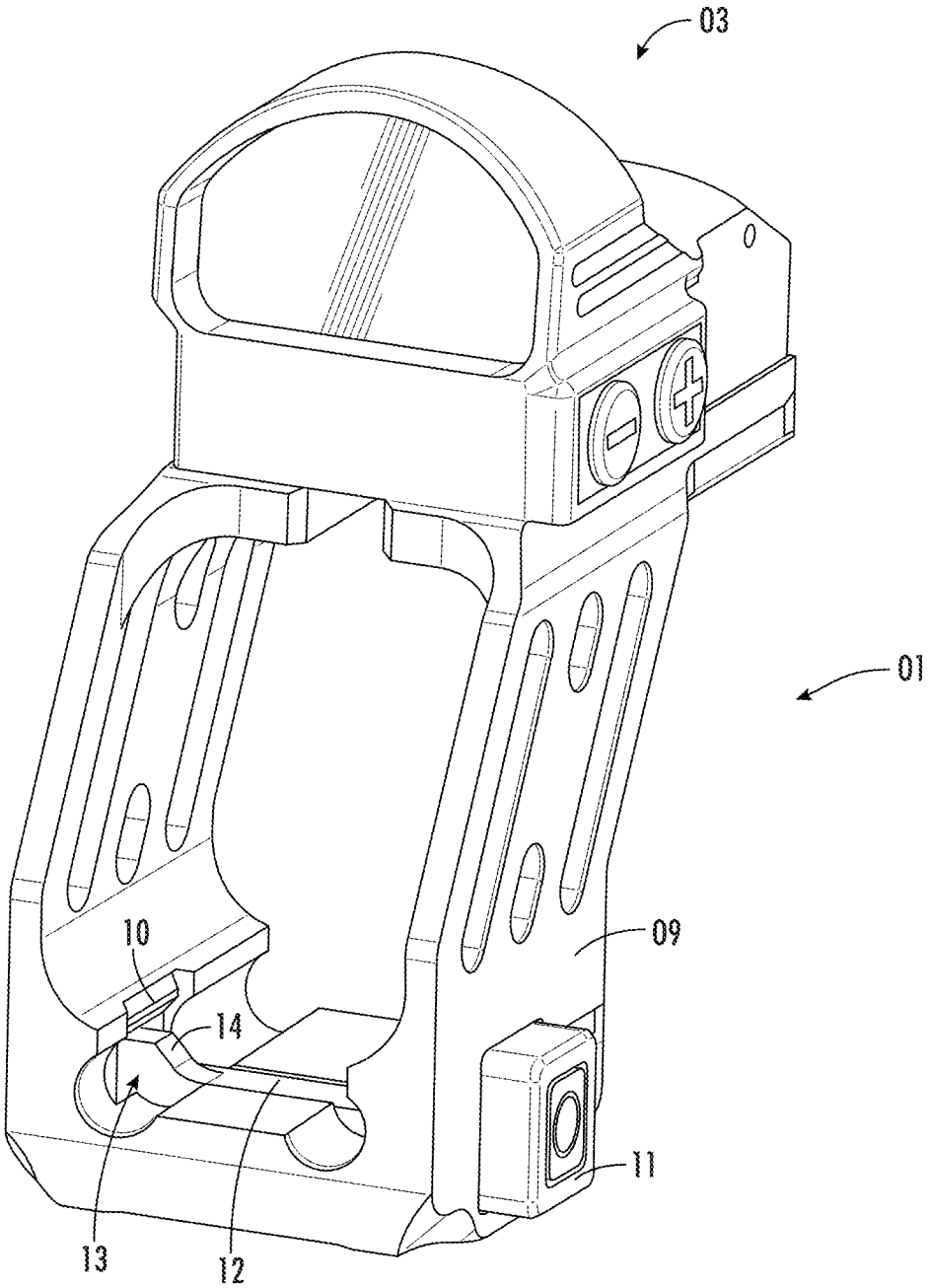
FIG. 6 is a first perspective side view of the device of FIG. 1.

FIG. 6 shows removed device 01 with sight 03 installed on top of body 09. The inner side of clamping jaw 10 for frictional fixation of device 01 on grip 04 is visible. A push bar 12 guided in a laterally sliding manner in body 09 of device 01 serves to transmit the actuating force from push button 11 to clamping jaw 10. A latching element 13 is molded to push bar 12 in one piece on the side of clamping jaw 10. A protrusion 14 of said latching element 13 can latch into a latching contour 15 (see FIG. 5) on the bottom of grip 04 of handgun 02. Once latching element 13 is latched, device 01 is secured to grip 04 in two ways, namely by clamping jaw 10 frictionally engaging grip 04 and by latching element 13 latching into latching contour 15 on grip 04 in a form-fitting manner.

Figure 7:
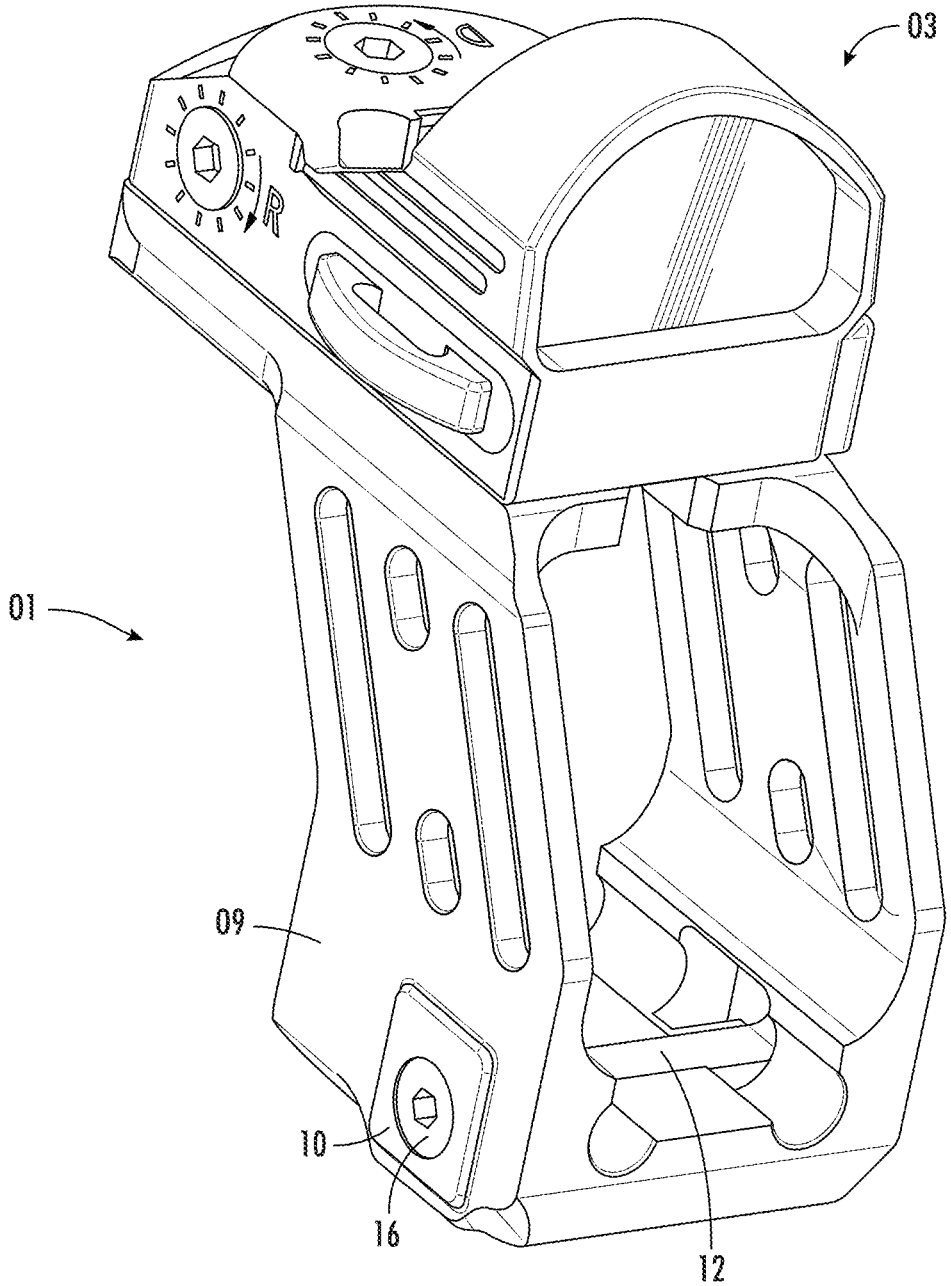
FIG. 7 is a second perspective side view of the device of FIG. 1.

FIG. 7 shows a second perspective view of device 01. As can be seen, clamping jaw 10 is fixed to the end of push bar 12 by a fixing screw 16.

Figure 8:
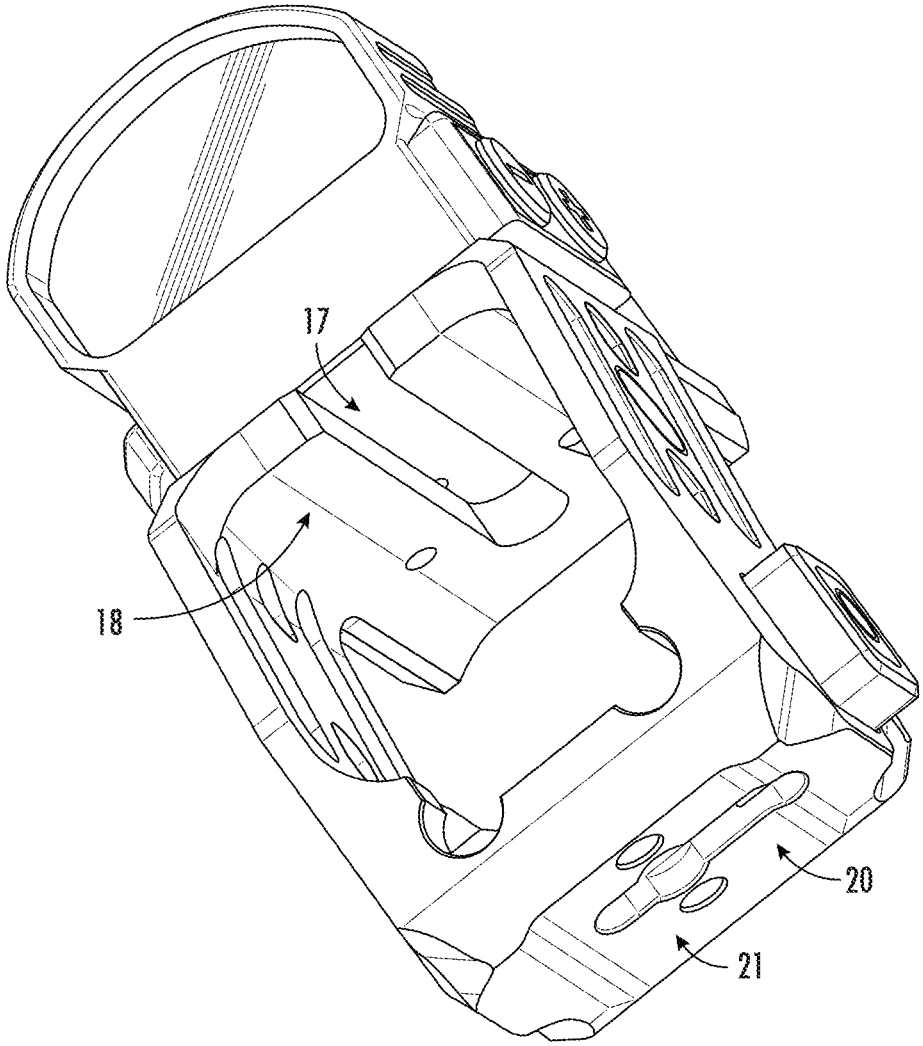
FIG. 8 is a third perspective side view of the device of FIG. 1.

FIG. 8 shows a perspective view of device 01 from below. A slit-shaped recess 17 in which front sight 19 (see FIG. 1) of handgun 02 can be accommodated when slide 06 is pulled back so as to avoid collision between front sight 19 and body 09 is visible on upper part 18 of body 09. An adapter means 21 to which other attachments, such as a light, can be attached, if required, is provided on lower part 20 of body 09.

Figure 9:
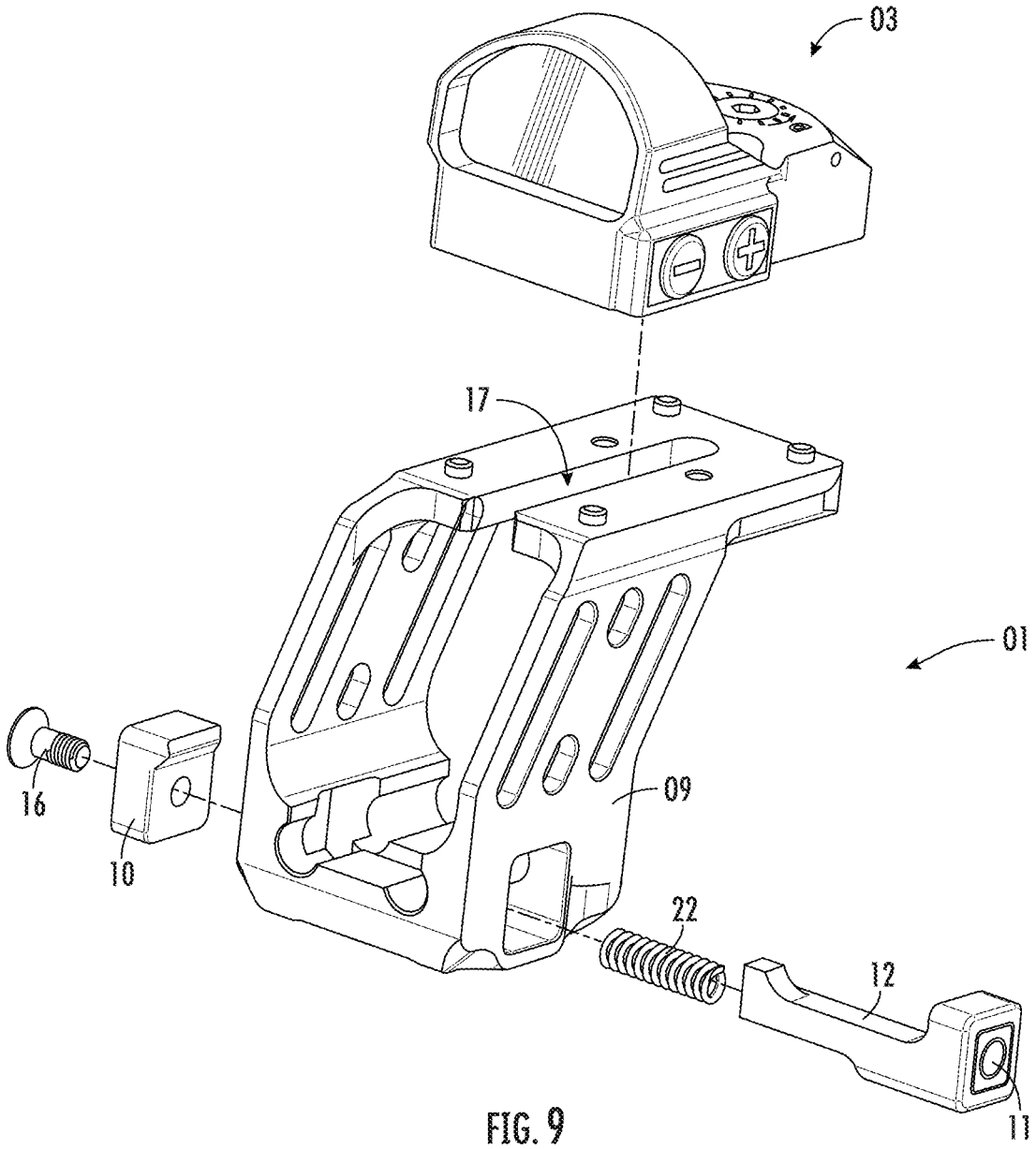
FIG. 9 is an exploded illustration of the device of FIG. 1.

FIG. 9 shows an exploded illustration of device 01. The actuation means formed by push bar 12 and push button 11 for actuating clamping jaw 10 is pretensioned by a tension spring 22 in order to push clamping jaw 10 against longitudinal edges 08 on grip 04 with the necessary pretension.

Figure 10:
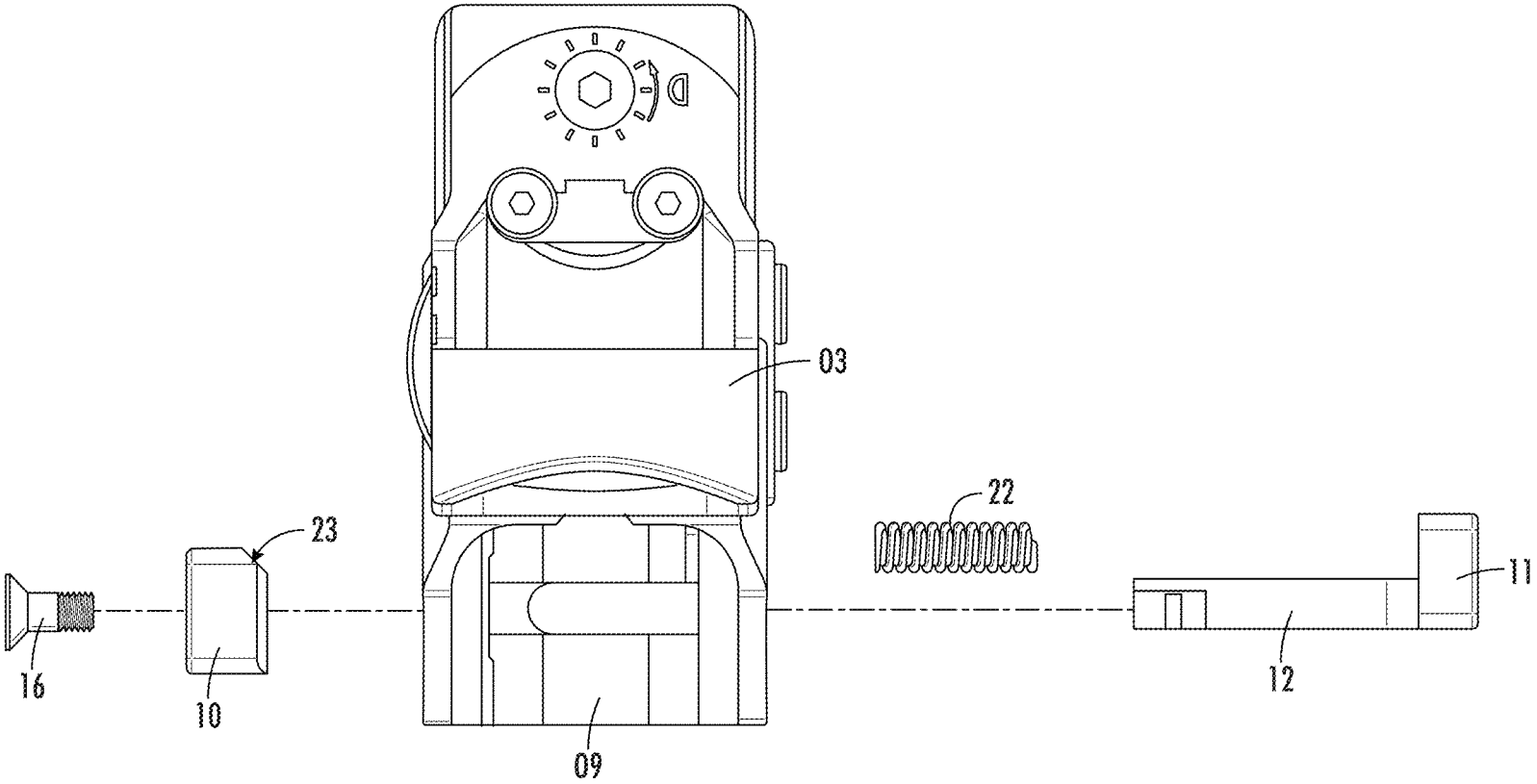
FIG. 10 is an exploded illustration of the device of FIG. 9 from above.

FIG. 10 shows an exploded illustration of device 01 from above. An insertion chamfer 23 is visible on clamping jaw 10, insertion chamfer 23 of clamping jaw 10 coming into contact with the front end of one of the two longitudinal edges 08 and thereby pulling clamping jaw 10 into its open position when device 01 is slid onto grip 04.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A device for attaching a sight to a mounting rail of a handgun, the handgun having a barrel, a grip, a slide and a foresight mounted on the slide, the mounting rail being disposed on an end of the grip of the handgun facing the barrel of the handgun, the device comprising complete annular body which can be slid onto the mounting rail in a form-fitting manner, wherein the complete annular body is configured such that in use when the device is attached to the handgun the complete annular body completely surrounds the slide, the foresight, the barrel and the mounting rail such that a gap for movement is provided between the slide and an inner circumference of the annular body, the device further comprising a clamping device comprising a clamping jaw movably mounted on an actuator, the clamping jaw being switchable by the actuator between an open position, in which the clamping jaw does not engage the mounting rail, and a clamping position, in which the clamping jaw engages the mounting rail in a fixing manner;

the device further comprising a surface on an upper part of the complete annular body, the surface adapted for receiving and mounting a sight to the device;

wherein the upper part of the complete annular body is configured such that, in use when the device is mounted to the handgun, a lower surface of the upper part is disposed adjacent to an upper surface of the slide at a level between the upper surface of the slide and the top of the foresight, wherein the upper part comprises a recess extending from a front of the upper part only partially toward the back of the upper part into which the foresight projects when the device is mounted to the handgun so that the recess can accommodate the foresight when the slide is operated.

2. The device according to claim 1, wherein the clamping jaw is configured to engage and thereby fix to at least one prismatic longitudinal edge of the mounting rail whose edge surfaces are disposed at angles relative to one another.

3. The device according to claim 1, characterized in that a latching element is provided on the clamping device, the latching element being able to latch into a latching contour on the grip of the handgun in a form-fitting manner when the clamping jaw is in the clamping position.

4. The device according to claim 1, comprising an insertion chamfer on at least one of the clamping jaw and the latching element, wherein the insertion chamber is configured such that, in use when the device is mounted on the handgun, the insertion chamfer comes into contact with an end of one of two prismatic longitudinal edges of the mounting rail and actuates the actuator to switch the clamping jaw from the clamping position into the open position when the body is slid onto the mounting rail.

5. The device according to claim 1, characterized in that the actuator comprises a tension spring that pretensions the clamping jaw in the clamping position.

6. The device according to claim 5, characterized in that the actuator comprises a manual actuation element that compresses the tension spring and that switches the clamping jaw from the clamping position into the open position against the spring force.

7. The device according to claim 6, characterized in that the manual actuation element is realized as a push button having a push bar attached thereto.

8. The device according to claim 7, characterized in that the latching element is integrated in the push bar in one piece.

9. The device according to claim 7, characterized in that the clamping jaw is fixed to the end of the push bar by a fixing screw.

10. The device according to claim 1, wherein the annular body comprises two side parts that present an offset between an upper part and a lower part of the annular body.

11. The device according to claim 1, characterized in that an adapter to which an attachment can be attached is provided on the lower part of the body located opposite the bottom of the grip.

12. The device according to claim 11 wherein the attachment comprises a light.

13. The device according to claim 1, characterized in that the body is made in one piece from aluminum or plastic.

14. A device for attaching a sight to a mounting rail of a handgun, the mounting rail being disposed on the end of the grip of the handgun facing the barrel, the device comprising:

(A) complete annular body means for sliding onto the mounting rail in a form-fitting manner and to surround the slide, the barrel and the mounting rail on the grip of the handgun, and a gap for movement being provided between the slide and the inner circumference of the complete annular body means, the complete annular body means being further for mounting a sight to the device;

(B) clamping jaw means for clamping the complete annular body means on the mounting rail;

(C) actuator means on which the clamping jaw means are movably mounted, the actuator means for switching the clamping jaw means between an open position and a clamping position, wherein, when the actuator device is in use mounted on the handgun and the clamping jaw means is in the open position, the clamping jaw means does not engage the mounting rail, and wherein when the actuator device is in use mounted on the handgun and the clamping jaw means is in the clamping position, the clamping jaw means engages the mounting rail in a fixing manner;

wherein the complete annular body means comprises an upper part that is configured such that, in use when the device is mounted to the handgun, the upper part is disposed adjacent to an upper surface of the slide with a lower surface of the upper part located at a level between the upper surface of the slide and the top of the foresight, wherein the upper part comprises a recess extending from a front of the upper part only partially toward the back of the upper part into which the foresight projects when the device is mounted to the handgun so that the recess can accommodate the foresight when the slide is operated.

15. The device according to claim 14, characterized in that the mounting rail has at least two prismatic longitudinal edges whose edge surfaces are disposed at angles relative to one another, the clamping jaw means engaging and thereby fixing one longitudinal edge when in the clamping position.

16. The device according to claim 14, characterized in that latching means is provided on the clamping jaw means, the latching means for latching into a latching contour on the grip of the handgun in a form-fitting manner when the clamping jaw means is in the clamping position.

17. The device according to claim 14, characterized in that an insertion chamfer is provided on at least one of the clamping jaw means and the latching means, the insertion chamfer coming into contact with the end of one of the two prismatic longitudinal edges of the mounting rail and actuating the actuator means to switch the clamping jaw means from the clamping position into the open position when the annular body means is slid onto the mounting rail.

18. The device according to claim 14, characterized in that the actuator means comprises a tension spring that pretensions the clamping jaw means in the clamping position.

19. The device according to claim 18, characterized in that the actuator means comprises a manual actuation element that compresses the tension spring and that switches the clamping jaw means from the clamping position into the open position against the spring force.

20. The device according to claim 19, characterized in that the manual actuation element is realized as a push button having a push bar attached thereto.

21. The device according to claim 20, characterized in that the latching means is integrated in the push bar in one piece.

22. The device according to claim 20, characterized in that the clamping jaw means is fixed to the end of the push bar by a fixing screw.

23. The device according to claim 14, characterized in that the two side parts present an offset between the upper part and the lower part of the annular body means.

24. The device according to claim 14, comprising adapter means for attaching an attachment is provided on the lower part of the annular body means located opposite the bottom of the grip.

25. The device according to claim 24 wherein the attachment comprises a light.

26. The device according to claim 14, characterized in that the annular body means is made in one piece from aluminum or plastic.

* * * * *